US007066288B2

(12) United States Patent
Van Klompenburg et al.

(10) Patent No.: US 7,066,288 B2
(45) Date of Patent: Jun. 27, 2006

(54) ASYMMETRIC COMPACT FOR DRILL BIT

(75) Inventors: Greg Van Klompenburg, The Woodlands, TX (US); Brian A. Baker, Spring, TX (US); Matthew R. Isbell, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 233 days.

(21) Appl. No.: 10/286,299

(22) Filed: Nov. 1, 2002

(65) Prior Publication Data

US 2003/0079917 A1 May 1, 2003

Related U.S. Application Data

(60) Provisional application No. 60/343,430, filed on Nov. 1, 2001.

(51) Int. Cl.
*E21B 10/16* (2006.01)

(52) U.S. Cl. ..... 175/431; 175/378; 175/413; 175/432

(58) Field of Classification Search ..... 175/331, 175/378, 412, 413, 327, 420.1, 426, 431; 15/104.13; 299/111
See application file for complete search history.

(56) References Cited

U.S. PATENT DOCUMENTS 4,086,973 A * 5/1978 Keller et al. ..... 175/374
4,334,586 A * 6/1982 Schumacher ..... 175/374
4,593,777 A 6/1986 Barr
5,172,777 A * 12/1992 Siracki et al. ..... 175/374
5,697,462 A * 12/1997 Grimes et al. ..... 175/374
5,813,485 A * 9/1998 Portwood ..... 175/430
6,003,623 A * 12/1999 Miess ..... 175/430
6,059,054 A * 5/2000 Portwood et al. ..... 175/430
6,161,634 A 12/2000 Minikus et al.
6,241,034 B1 6/2001 Steinke et al.
6,300,623 B1 * 10/2001 Charlier et al. ..... 250/252.1
6,367,568 B1 4/2002 Steinke et al.
6,412,577 B1 * 7/2002 Chen ..... 175/57
6,443,246 B1 9/2002 Pessier et al.
6,640,913 B1 * 11/2003 Lockstedt et al. ..... 175/331

FOREIGN PATENT DOCUMENTS

GB 2309242 A 7/1997
GB 2327443 A 1/1999

* cited by examiner

*Primary Examiner*—Kenneth Thompson
(74) *Attorney, Agent, or Firm*—Bracewell & Giuliani LLP

(57) ABSTRACT

Asymmetrical compacts are utilized in certain places on roller cones of an earth boring bit to increase the number of compacts in certain rows. The compacts that are pressed into holes in rows on the cones. The compacts are of tungsten carbide and have a cutting end axis and a barrel axis. The barrel axis intersects the cutting end axis at an obtuse angle. In the heel row, the barrel axis of at least some of the compacts is rotated to have less inclination than the cutting end axis. In an adjacent row to the heel row, each of the compacts has a barrel axis that is rotated to have more inclination than its cutting end axis and more inclination than the barrel axes of the heel row.

20 Claims, 6 Drawing Sheets

ASYMMETRIC COMPACT FOR DRILL BIT

CROSS-REFERENCE TO RELATED APPLICATION

Applicants claim the benefit of provisional application Ser. No. 60/343,430 filed Nov. 1, 2001.

FIELD OF THE INVENTION

This invention relates in general to earth boring bits, and in particular to a rolling cone boring bit that has tungsten carbide cutting elements or compacts, some of which have a cutting end that is offset from an axis of the barrel.

DESCRIPTION OF THE PRIOR ART

Many oil and gas wells are drilled with rolling cone bits. A rolling cone bit has depending bit legs, usually three, each of which supports a rotatable cone. The cone has cutting elements, which may be either milled teeth integrally formed on the surface or tungsten carbide compacts pressed into mating holes. As the bit is rotated about its axis, each cone rotates, causing the cutting elements to penetrate the earth formation.

Each compact has a cylindrical barrel with a flat bottom and a cutting end that protrudes from the opposite end of the barrel. The cutting end is generally domed-shaped in a variety of configurations, such as chisel-shaped, hemispherical, ovoid and the like. The prior art compact has a single axis that passes symmetrically through the barrel and through the cutting end. The cones have conical lands extending circumferentially around the cone. Holes are drilled in the cone normal to the lands. The compacts are pressed-fitted in an interference fit into the holes. Each cone has a gage surface that joins a heel area. Compacts with flat outer ends are located on the gage surface, while compacts with dome-shaped cutting ends are located on the heel area and other portions of the cone.

When drilling hard, abrasive rock, the bit life is typically limited by wear and subsequent loss of the compacts, particularly in the heel area. Increasing the number of compacts will extend the life of the bit. However, there is a limited amount of supporting metal in the cone. If the section of metal between each compact is too thin, the compacts would be lost. Increasing the number of compacts is thus limited by the metal section or thickness between the barrels of the compacts.

SUMMARY OF THE INVENTION

At least some of the compacts are formed with a cutting end that is asymmetrical relative to the barrel. The cutting end axis extends at an obtuse angle relative to the barrel axis. The asymmetry allows the barrel to be oriented farther from the barrels of adjacent compacts while the cutting ends remain at the same relative positions. In the heel row, the barrels of at least some of the compacts are rotated closer to the gage of the cone. The barrel axis intersects a vertical axis at a lesser angle than in the prior art, thus it inclines less.

In the case of a cone having an intermeshing heel and adjacent rows, the barrel axis of the adjacent row is rotated in the opposite direction from the barrel axis of the heel row. When viewed in a vertical section, the barrel axis of the adjacent row intersects the vertical axis at a greater angle than the barrel axis of the heel row, thus it has a greater angle of inclination. Barrel axes of the heel row and the adjacent row thus extend through the cutting ends in converging directions. The cutting end axis of each heel row compact is at a greater angle relative to vertical than the barrel axis of each heel row compact. On the other hand, the cutting end axis of each intermeshing adjacent row compact is at a lesser angle to vertical than the barrel axis of each adjacent intermeshing row compact.

The use of asymmetrical compacts results in more compacts in the heel and adjacent row than in the prior art without sacrificing support metal. The same approach may be used for heel and adjacent rows that are not intermeshing. Furthermore, asymmetrical compacts may be located in the nose area and other inner rows.

In a cone that has a heel row separated from the adjacent row by a considerable distance, compacts can be added to the heel row by alternating the orientation of the compacts. Every other heel row compact will differ in its orientation, thus resulting in two groups. In the first group, each of the heel row compacts has a barrel axis that is rotated to be more vertical. Each of the second group has a heel axis that is rotated to be less vertical. In one embodiment, these inserts are also asymmetrical, with each of the compacts of the first group having a cutting end axis that is less vertical than its heel axis. In the second group, the cutting end axis is more vertical than the heel axis. This allows the cutting ends to remain in the same position on the heel row in both groups.

In an alternate embodiment, the heel row has first and second groups of alternating compacts as described above. Each compact of the first group has a barrel axis that is at a lesser angle relative to vertical than the barrel axis of each compact of the second group. However, the cutting end axis and the barrel axis coincide with each other.

DETAILED DESCRIPTION OF THE PREFERRED EMBODIMENT

Figure 1:
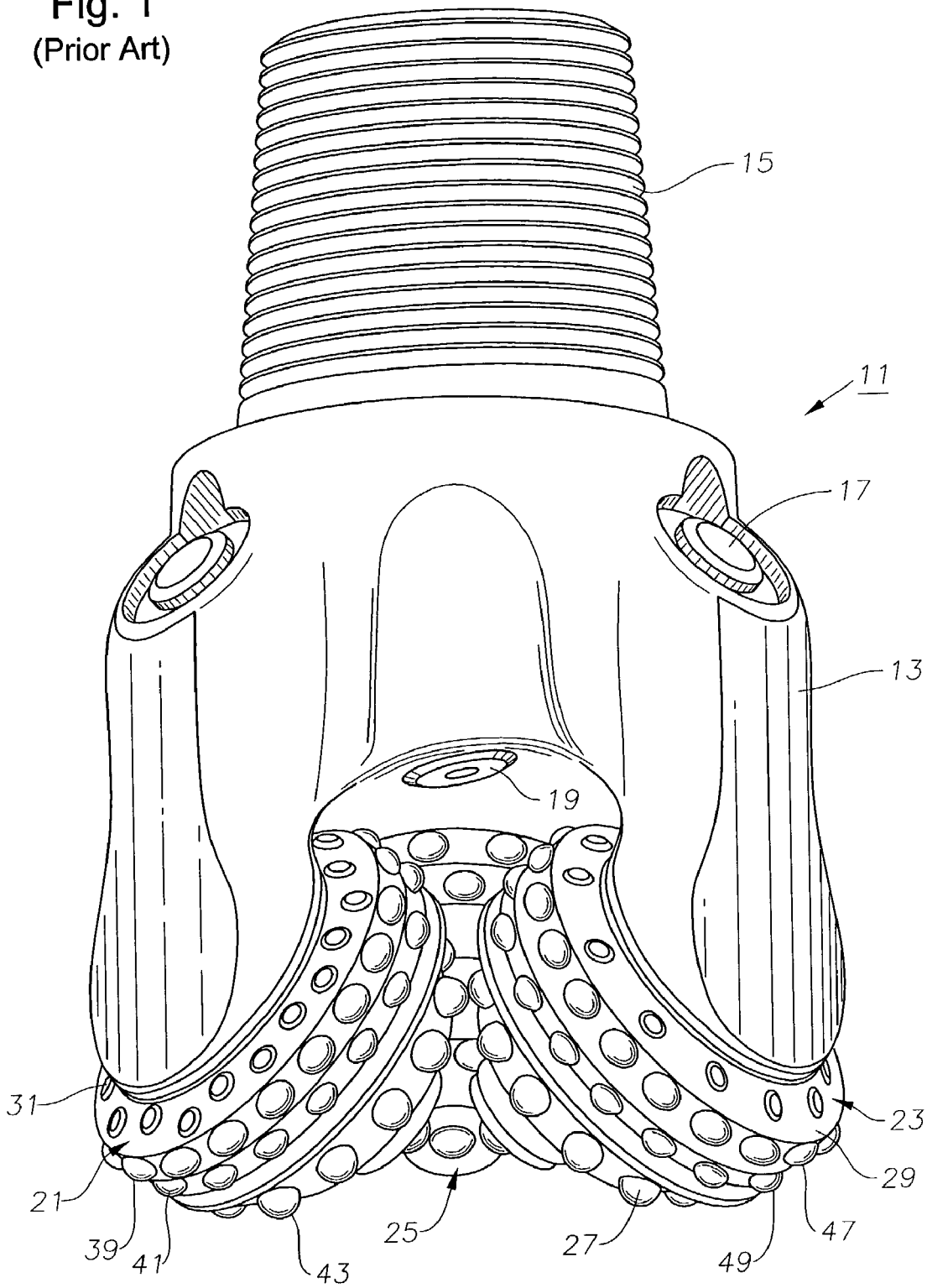
Fig. 1 (Prior Art)
FIG. 1 is a side elevational view of an earth boring bit constructed in accordance with this invention.

Referring to FIG. 1, earth boring bit 11 includes a bit body 13 that is threaded at its upper end 15 for connection into a drill string. Each leg or section of bit 11 is provided with a lubricant compensator 17. At least one nozzle 19 is provided in bit body 13 to discharge drilling fluid from within the drill string to cool and lubricate bit 11 during drilling operations. Three cutters or cones 21, 23, 25 are rotatably secured to a bearing shaft associated with each leg of bit body 13. Cones 21, 23, 25 have a plurality of inserts or compacts 27 for disintegrating the earth formation. Each cone 21, 23, and 25, also has a gage surface 29 with a plurality of gage compacts 31 with flat ends to prevent wear on gage surface 29.

Figure 2:
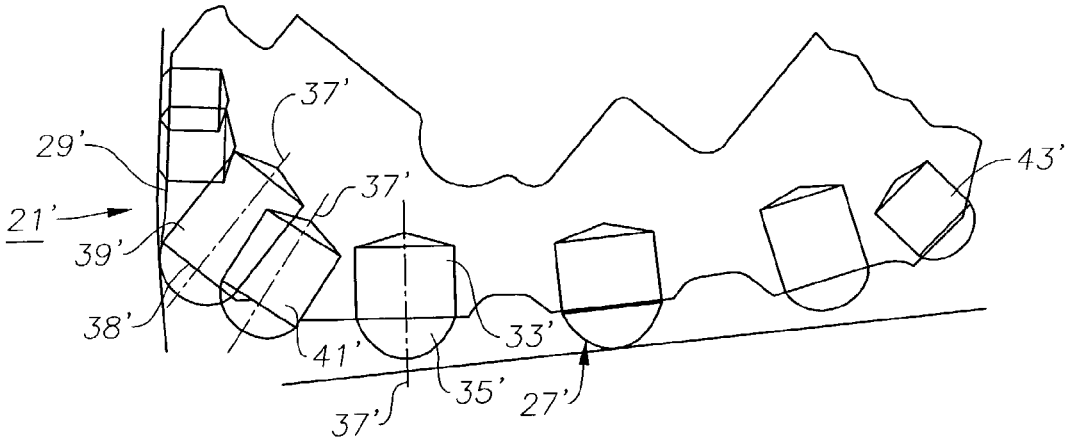
Fig. 2 (Prior Art)
FIG. 2 is a partial sectional view of a first cone for an earth boring bit of the prior art type.

FIG. 2 illustrates one prior art version of a cone 21'. Each compact 27' has a barrel 33' that is cylindrical and a bottom that is perpendicular to the compact axis 37'. A cutting end 35' protrudes from barrel 33'. Compact axis 37' extends symmetrically through barrel 33' and cutting end 35'. Compacts 27' of each row are mounted in holes in a conical land 38' that extends around cone 21'. Compact axis 37' is normal to land 38' and to a plane passing through the junction between barrel 33' and cutting end 35'. Cutting end 35' may be of a variety of shapes such as conical, chisel-shaped, hemispherical, ovoid, all of which are considered dome-shaped herein. Compacts 27' are particularly formed of sintered tungsten carbide molded under heat and pressure.

In cone 21', there is a heel row 39' and an adjacent row 41' that intermesh. Heel row 39' is the row located closest to gage surface 29' in a heel area that forms a junction with gage surface 29'. Each adjacent row compact 41' is located partially between two of the heel row compacts 39'. An outer portion of barrel 33' of each adjacent row compact 41' is located farther outward in a radial direction from the axis of rotation of the bit than an inner portion of barrel 33' of each heel row compact 39'. The compact axis 37' of each heel row compact 39', when viewed in a vertical plane as shown in FIG. 2, is slightly less vertical than axis 37' of adjacent row compacts 41'. Axis 37' of each heel row compact 39' intersects a vertical axis at a lesser angle than axis 37' of adjacent row compact 41'. Cone 21' also has a plurality of inner rows of compacts 27 inward from adjacent row compacts 41' as well has a nose compact 43' on its nose.

Figure 3:
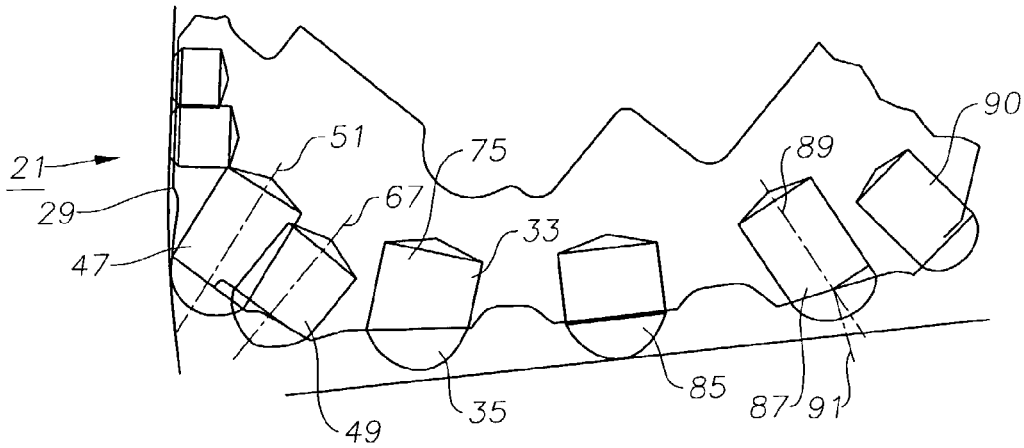
FIG. 3 is a partial sectional view of a first cone of the bit of FIG. 1.
Figure 4:
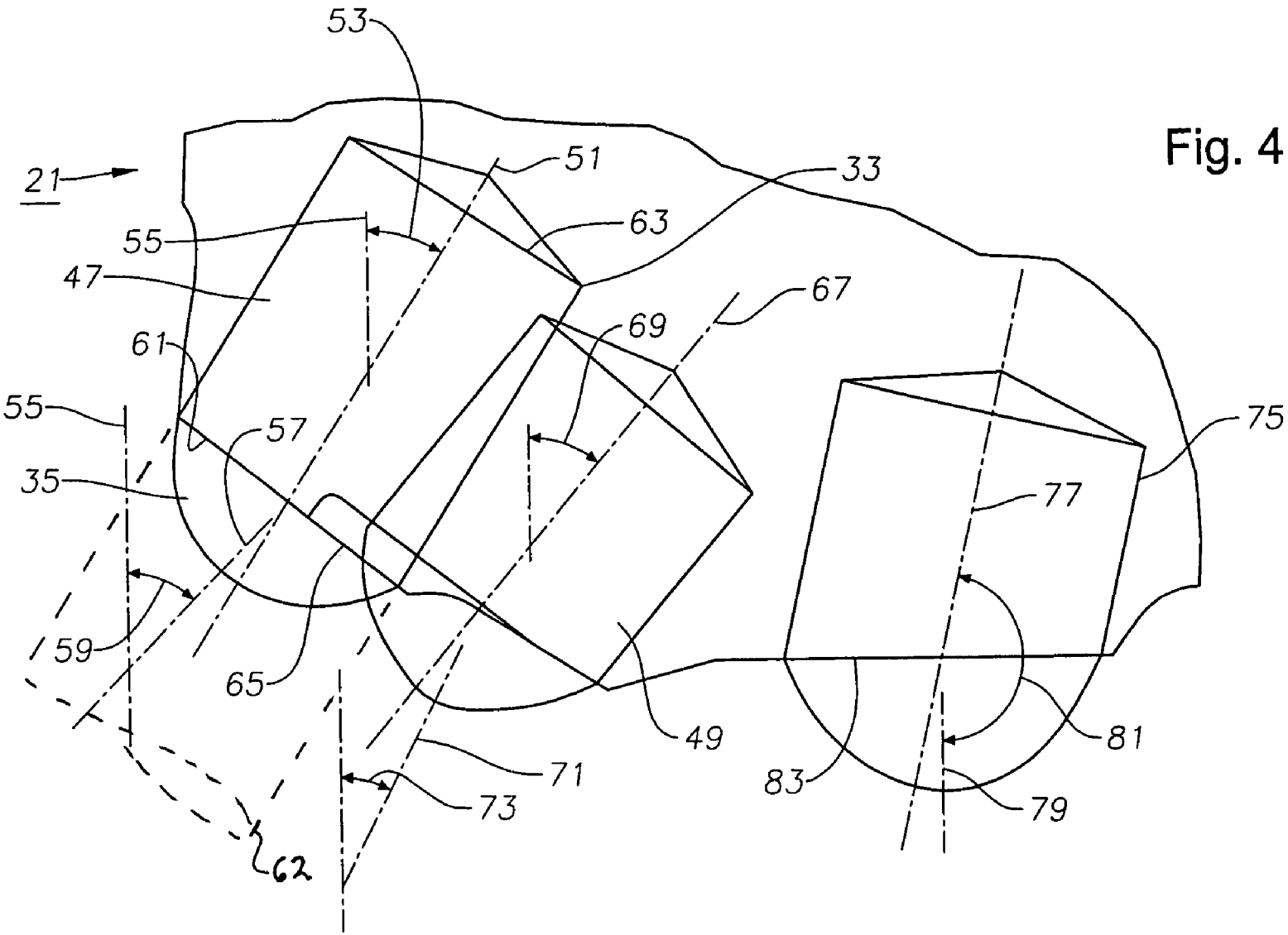
FIG. 4 is a further enlarged view of the heel and adjacent row compacts of the first cone shown in FIG. 3.

In cone 21 of this invention, as shown in FIGS. 3 and 4, heel row 47 extends to the full gage of the bit to cut the corner between the borehole sidewall and bottom. Adjacent row 49 is the first row inward from heel row 47 and extends to less than full gage. Heel row 47 and adjacent row 49 have less overlap or intermesh between the barrels 33 than the prior art heel row and adjacent row compacts 39', 41'. However, they still intermesh, and one of the adjacent row compacts 49 is closer to each heel row compact 47 than other adjacent row compacts 49. Similarly, each heel row compact 47 is closer to one of the adjacent row compacts 49 than to another heel row compact 47. Consequently, each heel row compact 47 is part of a proximal pair with one of the adjacent row compacts. Within each proximal pair, a heel row compact 47 has an outboard barrel 33 and an adjacent row compact 49 has an inboard barrel 33 because it is farther inward in a radial direction.

Each heel row compact 47 has a barrel axis 51 that is at a first angle of inclination 53 relative to a vertical axis 55. Of course, during operation, each compact 47 will be in the downward inclined vertical position of FIGS. 3 and 4 only once per revolution. Angle of inclination 53 is less than a similar angle for compact axis 37' of prior art heel row compacts 39'. In one embodiment, the difference between angle of inclination 53 and the corresponding angle of inclination of prior art compact 39' is about 7°, resulting in heel row barrel axis 51 being more vertical than in the prior art. This positions a part of barrel 33 of each heel row compact 47 closer to gage surface 29 than in the prior art of FIG. 2.

Cutting end 35 of heel row compact 47 has an axis 57 that is not coaxial with barrel axis 51 as in the prior art. Rather, cutting end axis 57 intersects barrel axis 51 at an obtuse angle and extends radially outward from barrel axis 51. Cutting end axis 57 intersects vertical axis 55 at an angle of inclination 59 that is less than angle of inclination 53 of barrel axis 51. In this embodiment, barrel axis 51 has been rotated 7° counterclockwise relative to cutting end axis 57. Cutting end axis 57 may be at the same angle of inclination relative to vertical axis 55 as compact axis 37' of the prior art (FIG. 2). Cutting end 35 of each heel row compact 47 is symmetrical about cutting end axis 57 and has the same shape as in the prior art, joining barrel 33 at a junction 61. Junction 61, however, is in a plane that is skewed relative to bottom 63 of barrel 33. Junction 61 is preferably flush with conical land 65, which may remain unchanged from land 38' of the prior art embodiment of FIG. 2, if desired.

Referring to the dotted lines in FIG. 4, an imaginary cylindrical projection 62 coincides with the outer diameter of barrel 33 and extends away from barrel 33 concentric to barrel axis 51. The entire cutting end 35 is located within and surrounded by projection 62. No portion of cutting end 35 is located farther from barrel axis 51 than the radius of barrel 33.

Conversely, each adjacent row compact 49 has a barrel axis 67 that is rotated clockwise relative to compact axis 37' of FIG. 2. Barrel axis 67 is at an angle of inclination 69 relative to vertical axis 55 that is greater than axis 37' of adjacent row compact 41' of the prior art. Angle of inclination 69 for barrel axis 67 is also greater than angle of inclination 53 for barrel axis 51 of heel row 47. Barrel axes 51, 67 thus may be considered to be in converging directions as they pass outward through cutting ends 35. In the prior art, compact axes 37' of heel row 39' and adjacent row 41' diverge as they pass outward through cutting ends 35'.

Each adjacent row compact 49 has a cutting end axis 71 that is at an obtuse angle relative to barrel axis 67. Cutting end axis 71 is at an angle of inclination 73 relative to vertical axis 55, angle 73 being less than angle of inclination 69 for barrel axis 67. Angle 73 may be the same angle as the prior art compact axis 37' for adjacent row insert 41' of the prior art. Preferably, barrel axis 67 is rotated 12° clockwise relative to cutting end axis 71, thus cutting end axis 71 extends radially inward from barrel axis 67.

Making the heel and adjacent row compacts 47, 49 asymmetrical and rotating the barrel axes 51, 67 in opposite directions as described has allowed the compact quantities to be increased over the prior art design of FIG. 2. In the design of FIG. 2, there were sixteen heel row compacts 39' and sixteen adjacent row compacts 41'. In the embodiment of FIGS. 3 and 4, twenty-three heel row compacts 47 and twenty-three adjacent row compacts 49 are utilized. Also, cutting ends 35 of compacts 47 and 49 maintain the same degree of intermesh as the prior art cutting ends 35' of compacts 39', 41'. Furthermore, the lengths and diameters of barrels 33 of compacts 47, 49 are the same as the lengths and diameters of the barrels of compacts 39', 41' of the prior art of FIG. 2.

Asymmetrical compacts may also be utilized in other rows on cone 21. In this embodiment, inner row 75 is located next to adjacent row 49. Inner row 75 compacts are constructed and mounted the same as in adjacent row 49 and heel row 47. Barrel axis 77 intersects cutting axis 79 at an obtuse angle 81 and is rotated clockwise from cutting end axis 79 to position its barrel 33 farther from barrel 33 of adjacent row 49. Cutting end axis 79 is preferably normal and perpendicular to land 83, although land 83 could be machined otherwise. The junction between barrel 33 and cutting end 35 coincides with land 83 in this embodiment. Barrel axis 77 is not perpendicular to land 83 as in the prior art. The asymmetry of each inner row compact 75 results in barrel 33 having a greater length from the bottom to the junction with cutting end 35 at one point than at a point 180° away. In this embodiment, twenty-one compact 75 are utilized, while in the prior art of FIG. 2, only eighteen are utilized in the corresponding row.

Referring to FIG. 3, in this embodiment, inner row 85 utilizes conventional compacts. Inner row 87, which is a row next to the nose of cone 21, preferably contains asymmetrical compacts as previously described. Each compact 87 has a barrel axis 89 that intersects a cutting end axis 91 at an obtuse angle. Barrel axis 89 has been rotated counterclockwise from cutting end axis 91, which is at the same inclination as in the prior art of FIG. 2. This placement allows nose compact 90 to have a greater length for its barrel 33 than the prior art nose compact 43' of FIG. 2.

Figure 5:
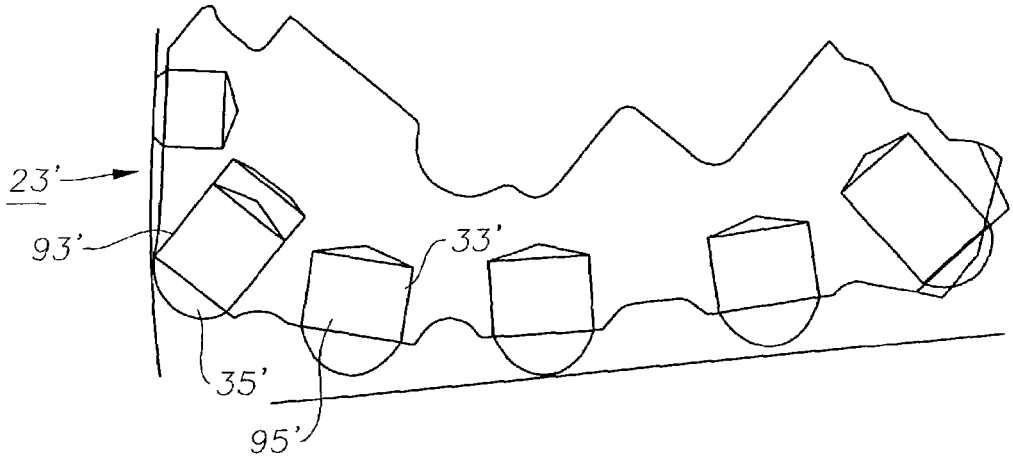
Fig. 5 (Prior Art)
FIG. 5 is a sectional view of a second cone for an earth boring bit of the prior art type.

Referring now to FIG. 5, a prior art cone 23' is shown. In cone 23', heel row 93' is spaced a considerable distance from adjacent row 95' so as to allow adjacent row compacts 41' of cone 21' (FIG. 2) to pass. In the prior art example shown, the lengths of barrels 33' alternate, with one shorter barrel followed by one longer barrel as taught in U.S. Pat. No. 6,443,246.

Figure 6:
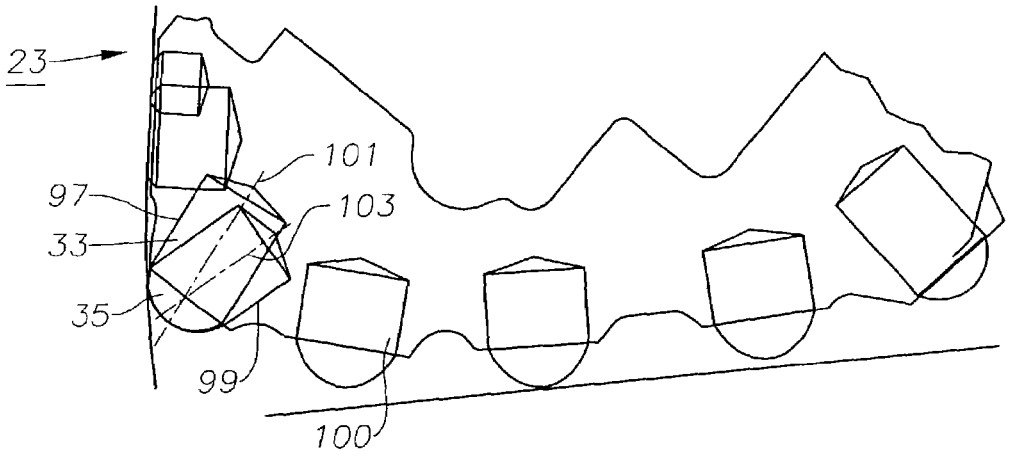
FIG. 6 is a sectional view of the second cone of the earth boring bit of FIG. 1.
Figure 8:
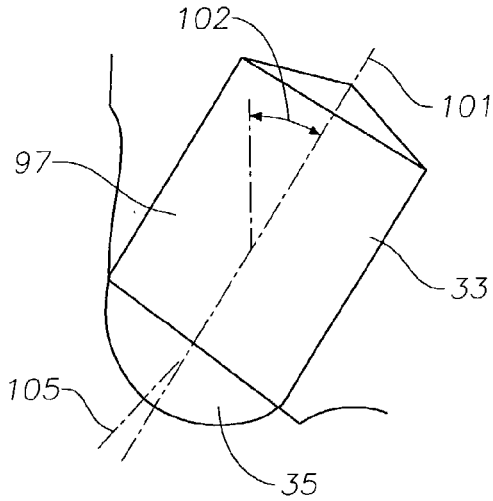
FIG. 8 is an enlarged sectional view of a heel row compact of a first group of the second cone as shown in FIG. 6.
Figure 9:
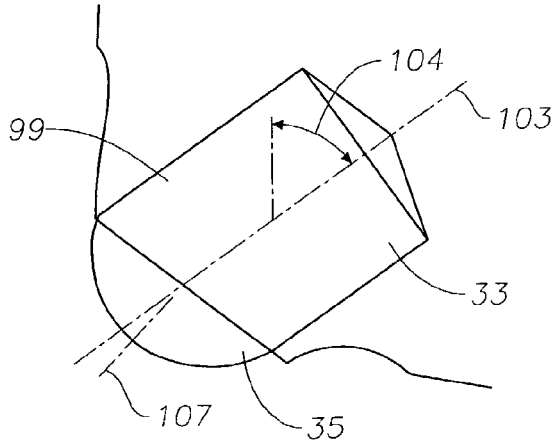
FIG. 9 is an enlarged sectional view of a heel row compact of a second group of the of the second cone of FIG. 6.

Referring to FIG. 6, the number of heel row compacts is increased from the prior art example of FIG. 5 by dividing the heel row compacts into two groups 97, 99, with a compact of group 97 alternating with a compact of group 99. In cone 23, heel row compacts 97 and 99 are closer to each other than to any of the adjacent row compacts 100. Thus, each heel row compact 97 forms a proximal pair with each heel row compact 97. In group 97, heel row axis 101 is at a lesser angle of inclination 102 to vertical (FIG. 8) than in the prior art of FIG. 5. Heel row axis 103 of second group 99 is at a greater angle of inclination 104 to vertical than in the prior art and also greater than angle of inclination 102. Heel row axis 101 of each heel row compact 97 thus has a lesser angle of inclination than heel row axis 103 for each heel row compact 99. When rotated into the same plane, as shown in FIG. 6, heel row axis 103 intersects heel row axis 101 at the junction between their barrels 33 and cutting ends 35.

Also, preferably, heel row compacts 97 and 99 are asymmetrical as described above. Cutting end axis 105 is an obtuse angle relative to heel row axis 101, shown in FIG. 8. Also, cutting end axis 105 is at a greater angle of inclination to vertical than angle 102 of barrel axis 101. Barrel axis 101 is rotated counterclockwise relative to cutting end axis 105. Cutting end axis 107 of the second group 99 is opposite in that it has a lesser angle of inclination than barrel axis 103. Cutting end axis 107 is also at an obtuse angle relative to barrel axis 103. Also, cutting axis 107 is at a lesser angle of inclination than angle 104 for barrel axis 103. Barrel axis 103 is rotated clockwise relative to cutting end axis 107. This results in cutting ends 35 for groups 97, 99 being at the same distance from the bit axis and the same angle of inclination. Thus a sectional plane as shown in FIG. 6 shows cutting ends for groups 97, 99 that are superimposed on one another.

The alternating groups 97, 99 in the heel row enables twenty-eight compacts to be placed therein in one embodiment, all of the compacts having the same barrel lengths. In the prior art example of FIG. 5, even though the barrel lengths alternated, only twenty-five compacts could be utilized of the same diameters as compacts 97, 99.

Figure 7:
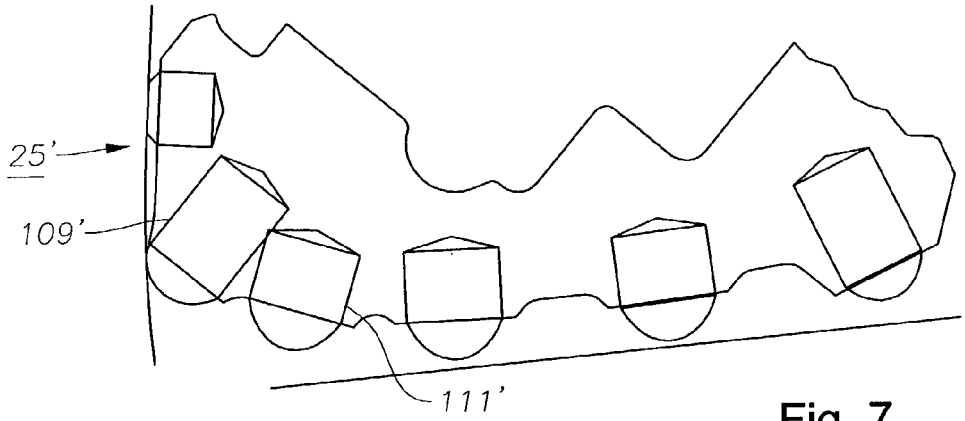
Fig. 7 (Prior Art)
FIG. 7 is a sectional view of a third cone for an earth boring bit of the prior art type.
Figure 10:
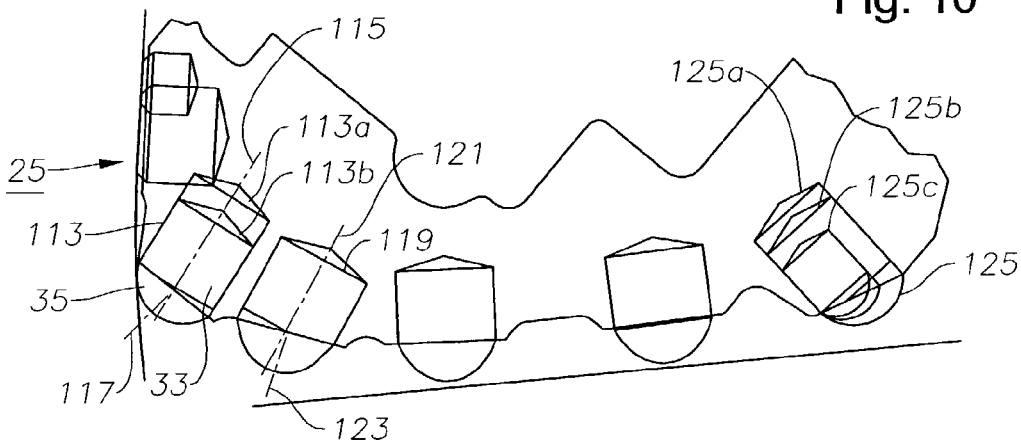
FIG. 10 is a partial sectional view of a third cone of the bit of FIG. 1.

FIG. 7 illustrates a prior art third cone 25'. In this embodiment, heel row 109' and adjacent row 111' do not intermesh, but they are much nearer each other than in the second cone 23' of FIG. 5. Referring to FIG. 10, each heel row compact 113 is closer to an adjacent row compact 119 than to any of the heel row compacts 113. Similarly, each adjacent row compact 119 is closer to one of the heel row compacts 113 than any of the adjacent row compacts 119.

Each heel row compact 113 forms a proximal pair with one of the adjacent row compacts 119. Heel row 113 preferably utilizes asymmetrical compacts and, if desired, they may alternate with each other in lengths as illustrated. Long barrel contacts 113*a* alternate with short barrel contacts 113*b*. Each heel row compact 113 has a barrel axis 115 that is rotated counterclockwise relative to cutting end axis 117 as in the previous discussions. Adjacent row 119 utilizes compacts of with uniform barrel lengths, but they are asymmetrical. Each has a barrel axis 121 and a cutting end axis 123 that intersects barrel axis 121 at an obtuse angle. Adjacent row barrel axis 121 is rotated 12° clockwise relative to adjacent row cutting end axis 123. The quantities of compacts in heel row 113 increase from twenty-one in the prior art example of FIG. 7 to twenty-six in FIG. 10. The adjacent row compacts 119 remain the same in number as the prior art in this example.

Also, in cone 25, asymmetrical compacts may be utilized in nose row 125, which is a row that encircles and is the closest of all rows to the apex. In this embodiment, there are three different barrel lengths, indicated by the numerals 125*a*, 125*b*, and 125*c*, utilized in the row. Also, there are two different diameters of the barrels. These asymmetrical inserts have a heel row axis and a cutting end axis that intersect each other at an obtuse angle.

Figure 11:
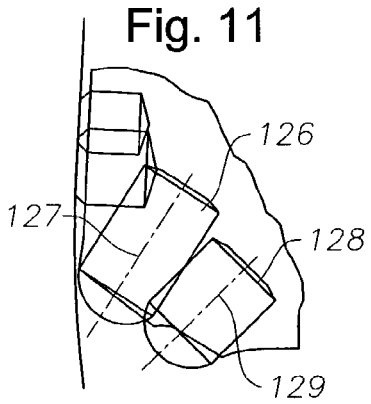
FIG. 11 is a partial sectional view of an alternate embodiment of a first cone for the bit of FIG. 1.

FIG. 11 illustrates an alternate embodiment to the intermeshing compacts of heel row 47 and adjacent row 49 of cone 21 as shown in FIG. 4. In FIG. 11, rather than being asymmetrical, the heel and adjacent row compacts 126, 128 are symmetrical. Heel row 126 has a single axis 127 that is symmetrical to the compact. Adjacent row 128 also has a common axis 129 for its cutting end and barrel. Axis 127 is oriented the same as barrel axis 51 of heel row 47 (FIG. 4). Axis 129 of adjacent row compacts 128 is oriented the same as barrel axis 67 of adjacent row compacts 49 of FIG. 4. That is, axes 127 and 129 extend outward through their cutting ends in a generally converging direction. Axis 127 is at a smaller angle of inclination than adjacent axis 129.

Figure 12:
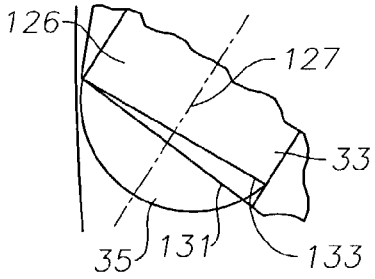
FIG. 12 is a further enlarged sectional view of a heel row compact of the cone shown in FIG. 11.
Figure 13:
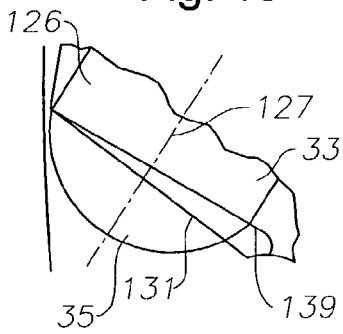
FIG. 13 is a sectional view of the heel row compact shown in FIG. 12, but showing a counterbore formed in the cone.

Referring to FIGS. 12 and 13, land 131 is shown at the same angle as land 65 of FIG. 4. The junction 133 between barrel 35 and cutting end 37 does not coincide with land 131. Rather, an inboard portion of junction 133 is recessed below the intersection of the hole for barrel 35 and land 131. While this recession is workable, it can be remedied by counterboring around each of the holes for barrel 35, as indicated by the numeral 139. This results in the junction 133 being flush with counterbore 139. The circumferential spaces between the compacts 126 or 128 may still contain land 131 at the original conical angle.

Figure 14:
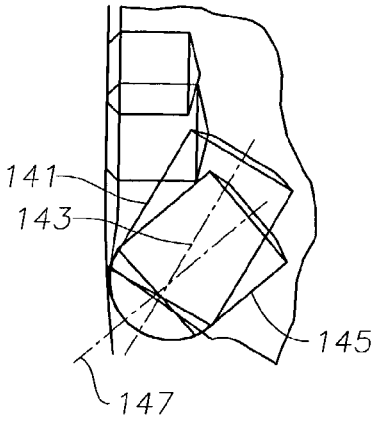
FIG. 14 is a partial sectional view of an alternate embodiment of the heel row of the second cone shown in FIG. 6.
Figure 15:
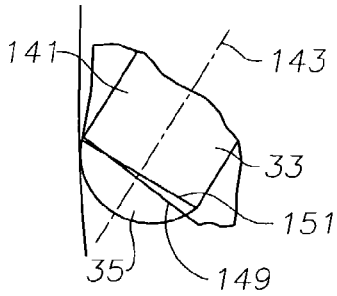
FIG. 15 is an enlarged sectional view of a first group compact of the heel row of FIG. 14.
Figure 16:
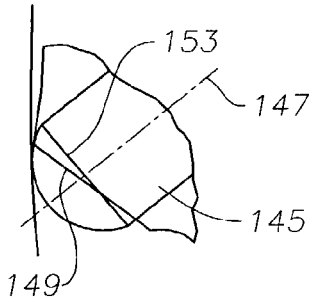
FIG. 16 is a sectional view of a second group compact of the heel row of FIG. 14.

FIGS. 14–16 illustrate an alternate embodiment to heel row groups 97, 99 of cone 23 of FIG. 6. Rather than asymmetrical compacts as in FIG. 6, first and second group compacts 141 and 145 are symmetrical. As in the embodiment of FIG. 6, each of the compacts 141 forms a proximal pair with one of the compacts 145. Each first group compact 141 has a heel row axis 143 that is positioned at the same angle of inclination as barrel axis 101 of FIG. 6. Each second group compact 145 has an axis 147 that is at the same angle of inclination as axis 103 of FIG. 6. The alternating inclinations of the first and second groups of compacts 141, 145 enable more compacts to be utilized in the heel row than in the prior art heel row 93' of FIG. 5. Compacts 113 and 119 of cone 25 could also feasibly made symmetrical rather than asymmetrical.

As shown in FIG. 15, if land 149 is at the same angle as in FIG. 6, it will not coincide with junction 151 between barrel 35 and cutting end 37 of first group compacts 141. Rather, an inboard portion of junction 151 will be recessed within the hole below land 149. A counterbore such as counterbore 139 of FIG. 13 could be utilized, if desired. In FIG. 16, outboard portion of junction 153 of second group compacts 145 will be recessed below land 149. An inboard portion of junction 153 will protrude slightly from land 149. Again, counterbores could utilized as in FIG. 13, if desired.

The invention has significant advantages. The asymmetrical inserts allow the barrel axis to be rotated to more desirable locations without changing the location of the cutting end. This allows for greater density of compacts. Alternating the inclinations of the barrel axis in the heel row of one of the cones allows a greater density of compacts to be utilized without sacrificing support metal.

While the invention has been shown in only a few of its forms, it should be apparent to those skilled in the art that it is not so limited but susceptible to various changes without departing from the scope of the invention.

The invention claimed is:

1. An earth boring bit, comprising:

a bit body, having at least one depending bit leg;

a rotatable cone mounted to the leg;

a heel row of compacts and an adjacent row of compacts on the cone, the heel row extending to a full gage of the cone, and the adjacent row being located next to the heel row and extending to less than full gage of the cone, each of the heel row and adjacent row compacts having a cylindrical barrel that is interferingly pressed into a mating hole in the cone and a cutting end that protrudes from the cone, the cutting end being symmetrical about a cutting end axis, each of the barrels having a barrel axis;

the cutting end axis for at least some of the heel row and adjacent row compacts extending at an obtuse angle relative to its barrel axis; and wherein:

the barrel axis of each of the compacts in the heel row is at a lesser angle relative to the bit axis than the barrel axis of each of the compacts in the adjacent row.

2. The bit according to claim 1, further comprising an inner row of compacts next to and radially inward from the adjacent row relative to the bit axis, each of the compacts of the inner row having a barrel with a barrel axis and a symmetrical cutting end with a cutting end axis that extends at an obtuse angle relative to its barrel axis.

3. The bit according to claim 2, wherein the cutting end axis of each of the compacts of the inner row inclines from its barrel axis in a radially inward direction relative to the bit axis.

4. An earth boring bit, comprising:

a bit body, having at least one depending bit leg;

a rotatable cone mounted to the leg;

a plurality of rows of compacts on the cone, each of the compacts having a cylindrical barrel that is interferingly pressed into a mating hole in the cone and a cutting end that protrudes from the cone;

at least some of the compacts having a cutting end axis that extends at an obtuse angle relative to a barrel axis; wherein the rows of compacts comprise a heel row and an adjacent row located next to and radially inward from the heel row relative to a bit axis of rotation;

said at least some of the compacts comprise the compacts in the heel row and the compacts in the adjacent row;

the cutting end axis of each of the compacts in the heel row inclines from its barrel axis in a radially outward direction relative to the bit axis;

the cutting end axis of each of the compacts in the adjacent row inclines from its barrel axis in a radially inward direction relative to the bit axis; and the barrel axis of each of the compacts in the heel row is at a lesser angle relative to the bit axis than the barrel axis of each of the compacts in the adjacent row.

5. The bit according to claim 4, wherein:

the compacts in the heel row and the adjacent row intermesh with each other such that an innermost portion of the barrel of each of the compacts in the heel row is closer to the bit axis than an outermost portion of the barrel of each of the compacts in the adjacent row.

6. An earth boring bit, comprising:

a bit body, having a bit axis of rotation and at least one depending bit leg;

a rotatable cone mounted to the leg;

a plurality of rows of compacts on the cone, each of the compacts having a cylindrical barrel that is interferingly pressed into a mating hole in the cone and a cutting end that protrudes from the cone;

at least some of the compacts having a cutting end axis that extends at an obtuse angle relative to a barrel axis; wherein the rows of compacts comprise a heel row located adjacent a gage of the cone;

said at least some of the compacts are located in the heel row;

the barrel axes of alternating ones of the compacts in the heel row incline further outward relative to the bit axis than the barrel axes of the other compacts of the heel row; and all of the cutting ends of the compacts in the heel row being located the same distance to the bit axis.

7. An earth boring bit, comprising:

a bit body, having at least one depending bit leg;

a rotatable cone mounted to the leg, the cone having a gage surface that joins a heel area;

a plurality of asymmetrical compacts in a heel row on the heel area of the cone, in an adjacent row next to and radially inward from the heel row, relative to a bit axis of rotation, and in an inner row next to and radially inward from the adjacent row relative to the bit axis, each of the asymmetrical compacts having a cylindrical barrel that is interferingly pressed into a mating hole in the cone and a cutting end that protrudes from the cone;

each of the asymmetrical compacts having a cutting end axis and a barrel axis, the cutting end axis of at least some of the asymmetrical compacts being at a different angle relative to the bit axis of rotation than the barrel axis;

the cutting end of each of the asymmetrical compacts being symmetrical about its cutting end axis; and wherein an imaginary cylindrical projection of the same diameter and extending coaxially from the barrel surrounds the cutting end.

8. The bit according to claim 7, the cutting end axis of each of the asymmetrical compacts of the adjacent row is at a lesser angle relative to the bit axis than its barrel axis.

9. The bit according to claim 7, wherein the barrel axis and cutting end axis of each of the asymmetrical compacts intersect each other at a junction between the cutting end and the barrel.

10. The bit according to claim 7, wherein the cutting end of each of the asymmetrical compacts is generally hemispherical in configuration.

11. The bit according to claim 7, wherein:

the cutting end axis of each of the asymmetrical compacts of the adjacent row is at a lesser angle relative to the bit axis than its barrel axis ; and wherein the barrel axis of each of the asymmetrical compacts in the heel row is at a lesser angle than the barrel axis of each of the asymmetrical compacts of the adjacent row relative to the bit axis.

12. The bit according to claim 7, wherein the asymmetrical compacts in the heel and adjacent rows intermesh with each other such that an innermost portion of the barrel of each of the asymmetrical compacts of the heel row is closer to the bit axis than an outermost portion of the barrel of each of the axymmetrical compacts of the adjacent row.

13. An earth boring bit, comprising:

a bit body having a bit axis of rotation and at least one depending bit leg;

a rotatable cone mounted to the leg, the cone having a gage surface that joins a heel area;

a plurality of asymmetrical compacts in a heel row on the heel area of the cone, each of the asymmetrical compacts having a barrel that is interferingly pressed into a mating hole in the cone and a cutting end that protrudes from the cone, the cutting ends of each of the compacts in the heel row being located the same distance to the bit axis;

each of the asymmetrical compacts in the heel row having a cutting end axis and a barrel axis, the cutting end axis of at least some of the asymmetrical compacts being at a greater angle relative to the bit axis than its barrel axis; and wherein the barrel axes of alternating ones of the asymmetrical compacts in the heel row incline further outward relative to the bit axis than the barrel axes of the other asymmetrical compacts of the heel row.

14. An earth boring bit, comprising:

a bit body having a bit axis of rotation and three depending bit legs;

rotatable first, second and third cones mounted to the legs, each of the cones having a gage surface that joins a heel area;

a plurality of heel row compacts in a heel row on the heel area of the first cone;

a plurality of adjacent row compacts in the first cone located radially inward relative to the bit axis and next to the heel row compacts;

each of the heel row and adjacent row compacts in the first cone having a barrel that is interferingly pressed into a mating hole in the first cone and a cutting end that protrudes from the first cone, the barrel of each of the compacts having a barrel axis;

each of the heel row compacts of the first cone having a cutting end axis that inclines from its barrel axis radially outward relative to the bit axis;

each of the adjacent row compacts of the first cone having a cutting end axis that inclines from its barrel axis radially inward relative to the bit axis;

a plurality of heel row compacts mounted on the second cone, each of the heel row compacts in the second cone having a barrel that is interferingly pressed into a mating hole in the second cone and a cutting end that protrudes from the second cone, the barrel of each of the heel row compacts of the second cone having a barrel axis;

the heel row compacts of the second cone being positioned in first and second groups that alternate with one another, with the barrel axis of each of the heel row compacts in the first group inclining at a lesser angle of inclination relative to the bit axis than the barrel axis of each of the heel row compacts of the second group;

each of the heel row compacts of the first group having a cutting end axis that is at a greater inclination relative to the bit axis than its barrel axis; and each of the heel row compacts of the second group having a cutting end axis that is at a lesser inclination relative to the bit axis than its barrel axis.

15. The bit according to claim 14, further comprising:

a plurality of heel row compacts in a heel row on the heel area of the third cone;

a plurality of adjacent row compacts in the third cone next to and radially inward from the heel row compacts;

each of the heel row and adjacent row compacts in the third cone having a barrel that is interferingly pressed into a mating hole in the third cone and a cutting end that protrudes from the third cone, the barrel of each of the heel row and adjacent row compacts in the third cone having a barrel axis;

the barrel axis of each of the heel row compacts of the third cone having an angle of inclination relative to the bit axis; and the barrel axis of each of the adjacent row compacts of the third cone having an angle of inclination relative to the bit axis that is greater than the angle of inclination of the barrel axis of each of the heel row compacts.

16. The bit of claim 14, further comprising:

a nose area compact having a barrel that is interferingly pressed into a mating hole adjacent an apex of a third cone and a cutting end that protrudes from the third cone;

the nose compact having a cutting end axis that is skewed relative to an axis of its barrel.

17. An earth boring bit, comprising:

a bit body, having at least one depending bit leg;

a rotatable cone mounted to the leg, the cone having a gage surface that joins a heel area;

a plurality of compacts in a heel row on the heel area of the cone, an adjacent row next to and radially inward from the heel row, relative to a bit axis of rotation, and an inner row next to and radially inward from the adjacent row, each of the compacts having a cylindrical barrel that is interferingly pressed into a mating hole in the cone and a cutting end that protrudes from the cone;

the holes for the compacts of the inner row being formed in a conical inner row land formed on the cone; and each of the holes for the compacts of the inner row having a hole axis that is inclined relative to the inner row land.

18. The bit according to claim 17, wherein:

the adjacent row of compacts extends to less than full gage;

the holes for the compacts of the adjacent row are formed in a conical adjacent row land formed on the cone; and each of the holes for the compacts of the adjacent row having a hole axis that is inclined relative to the adjacent row land.

19. An earth boring bit, comprising:

a bit body, having at least one depending bit leg;

a rotatable cone mounted to the leg, the cone having a gage surface that joins a heel area;

a plurality of heel row compacts on the heel area of the cone;

a plurality of adjacent row compacts in an adjacent row next to and radially inward from the heel row compacts, relative to a bit axis of rotation;

a plurality of inner row compacts in an inner row next to and radially inward from the adjacent row compacts;

each of the inner row compacts having a cylindrical barrel that is interferingly pressed into a mating hole in the cone and a cutting end that protrudes from the cone;

the cutting end of each of the inner row compacts being generally dome-shaped and having a cutting end axis that extends at an obtuse angle relative to a barrel axis, the cutting end being symmetrical when rotated around the cutting end axis; and wherein an imaginary cylindrical projection having the same diameter and extending coaxially from the barrel completely surrounds the cutting end.

20. The bit according to claim 19, wherein the cutting end axis of each of the inner row compacts extends from its barrel axis in a radially inward direction relative to the bit axis.

* * * * *